US005917411A

United States Patent [19]

Baggarly

[11] Patent Number: 5,917,411

[45] Date of Patent: Jun. 29, 1999

[54] ELECTRONIC MAILBOX WITH KEYPAD ALARM SYSTEM

[76] Inventor: James H. Baggarly, 4625 Belleview St. West, Tacoma, Wash. 98466

[21] Appl. No.: 09/098,361

[22] Filed: Jun. 16, 1998

Related U.S. Application Data

[60] Provisional application No. 60/050,576, Jun. 23, 1997.

[51] Int. Cl.[6] ..... G08B 13/14

[52] U.S. Cl. ..... 340/569; 340/309.15; 232/36

[58] Field of Search ..... 340/569, 568.1, 340/309.15, 309.4; 232/17, 34–37, 45

[56] References Cited

U.S. PATENT DOCUMENTS

| | | | |
|---|---|---|---|
| 1,436,609 | 11/1922 | Semenoff . | |
| 3,295,124 | 12/1966 | Burleson et al. | 340/281 |
| 3,935,994 | 2/1976 | Darvishian | 232/36 |
| 4,154,393 | 5/1979 | Darvishian | 232/36 |
| 4,163,225 | 7/1979 | Engel | 340/569 |
| 4,314,102 | 2/1982 | Lowe et al. | 179/2 |
| 4,860,949 | 8/1989 | Moore | 232/35 |
| 4,872,210 | 10/1989 | Benages | 340/569 |
| 4,964,565 | 10/1990 | Wood | 232/35 |
| 4,965,551 | 10/1990 | Box | 340/545 |
| 5,247,282 | 9/1993 | Marshall | 340/569 |
| 5,255,843 | 10/1993 | Deakyne | 232/35 |
| 5,377,906 | 1/1995 | Mason | 232/34 |
| 5,440,294 | 8/1995 | Mercier et al. | 340/569 |
| 5,774,053 | 6/1998 | Porter | 340/568 |

FOREIGN PATENT DOCUMENTS 2 205 670 12/1988 United Kingdom .

OTHER PUBLICATIONS

Brookstone — Hard–to–Find Tools — Winter 1998 Catalog p. 18.

*Primary Examiner*—Jeffery A. Hofsass
*Assistant Examiner*—Sihong Huang
*Attorney, Agent, or Firm*—Kathleen T. Petrich

[57] ABSTRACT

An electronic mailbox including a mailbox housing (12), a door (16), an alarm system (20), a door sensor (34) a first timer, a second timer, a programmable controller (26), and a power source (42). Housing (12) defines an opening of a size and shape to receive mail. Door (16) is of a size and shape to cover opening (14). Door (16) is movably operable between an open state and a closed state. The alarm system (20) is controlled by the controller (26) between a first unarmed state and a second armed state. A keypad (22), door sensor (34) and timers input signals to controller (26). The timers along with the door state determine whether the armed state or unarmed state is in effect. Controller (26) sends output signals to activate the alarm system when the door (16) is opened by an unauthorized user. An authorized user inputs a deactivating code into the keypad (32) to deactivate the alarm system. Optional LED mail deposit indicator, latching (locking) mechanism, and illuminating lights(s) may be provided.

28 Claims, 9 Drawing Sheets

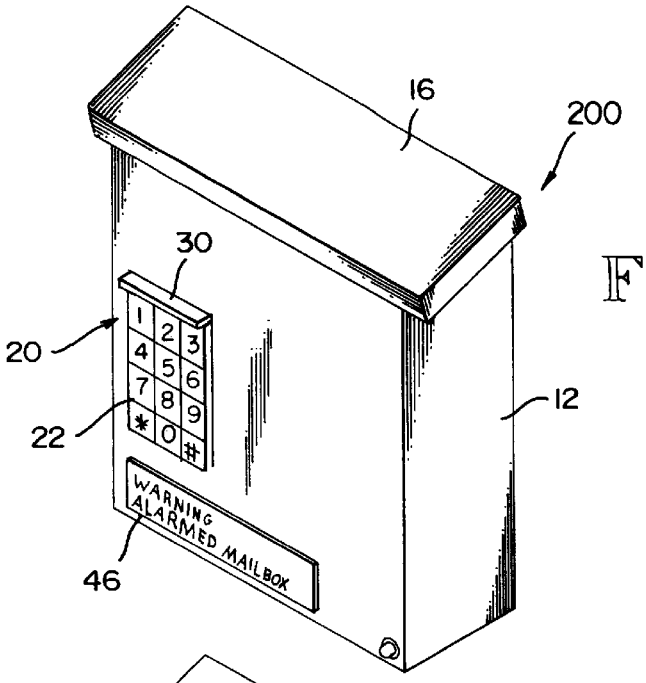
FIG. 5
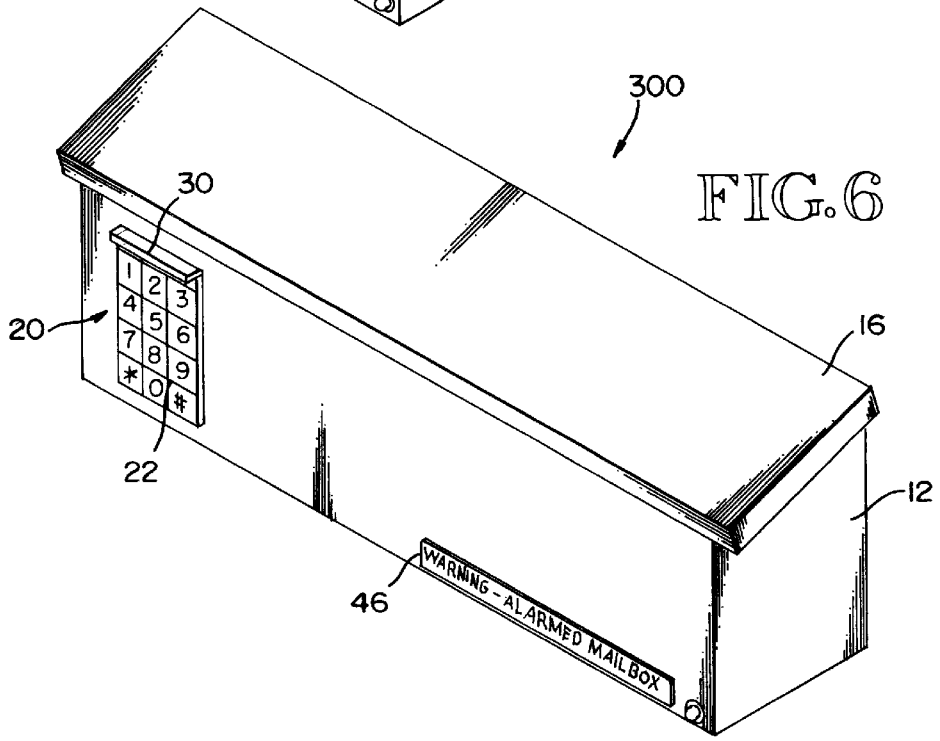
FIG. 6
FIG. 7
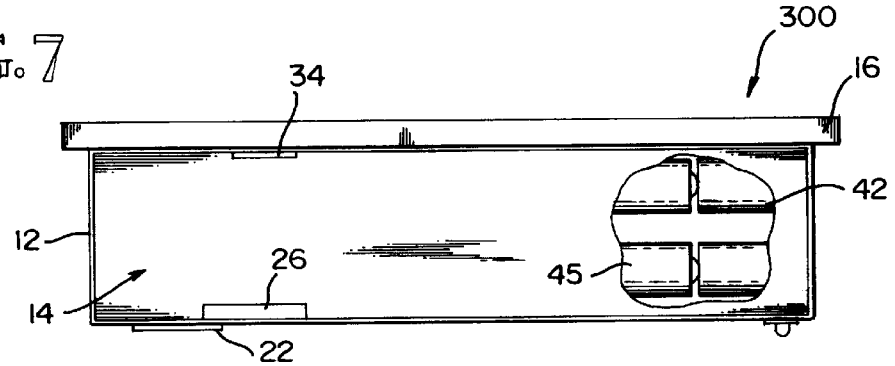

ELECTRONIC MAILBOX WITH KEYPAD ALARM SYSTEM

RELATED APPLICATION

This application claims priority to applicant's earlier U.S. provisional application Ser. No. 60/050,576, filed Jun. 23, 1997, and entitled "Electronic Mailbox With Keypad Alarm System."

Technical Field

The present invention relates to electronic mailboxes. More particularly, the present invention relates to an electronic mailbox with a keypad alarm system and a programmed timed delay system to enable those who are authorized to access the mail without triggering the alarm.

BACKGROUND OF THE INVENTION

Mail theft has become a very costly problem for the government and the public. This problem has become a great concern for the U.S. Post Office as well as private individuals. Those that receive their income and/or medications through the mail are the most susceptible to mail theft.

Various alarm systems have been used in combination with a mailbox. However, these systems are generally too cumbersome or too costly to be commercialized with any success. Additionally, an object of the present invention is to provide an easy to use, relatively low cost alarm system for a mailbox as a deterrent to mail theft. Another object is to have the alarm system be activated by a microcontroller controlled circuit board that includes a timer to allow the user and mail person to access the mailbox without triggering the alarm, but to arm the system once mail is delivered. Another object is to have a programed low power ("sleep") mode to reduce wear on the power source.

DISCLOSURE OF THE INVENTION

The present invention provides a timed electronic alarm system for a mailbox that also includes optional mail receipt indication, a locking mechanism, and illumination lights.

The mailbox of the present invention includes a mailbox housing that defines an opening of a size and shape to receive mail. The mailbox also includes a door of a size and shape to cover the opening. The door is movably operable between an open state and a closed state. The open state is that in which the opening is accessible. The closed state is that in which the door is closed over the opening.

The mailbox also includes an alarm system that is operably controlled by a programmed controller between a first unarmed state and a second armed state. Alternatively, the controller may be programmable or a combination of the two. The alarm system includes an alarm and a programmable keypad. The alarm emits an audible sound when activated in the second armed state. The programmable keypad is mounted externally of the mailbox and can accept a deactivating code by an authorized user in order to deactivate the alarm in the second armed state.

The mailbox of the first embodiment also includes a door sensor that senses and signals a change of the doors status between the open and closed states. Such change of status is signaled to the controller.

The mailbox also includes a first and second timer which are both operably controlled by the controller. The first timer is activated by opening the door in the first unarmed state. The second timer is activated in the second armed state either by expiration of the first timer or by receiving a signal that the door is in the closed state after initial opening of the door in the unarmed state.

Last, the electronic mailbox of the first embodiment includes a power source to provide electrical power to the controller, door sensor, and alarm system.

In use, a mail delivery person opens the door and delivers mail into the opening of the mailbox housing in the unarmed state, which does not activate the alarm. However, such opening of the mailbox in the unarmed state sets the first timer. The expiration of the first timer or closure of the door switches the alarm system into the second armed state. Either the expiration of the second timer or the entry of a deactivation code on the keypad deactivates the alarm system. The alarm system is then switched to the first unarmed state. However, opening of the door in the armed state will activate the alarm unless the deactivation code is entered prior to opening the door.

In another embodiment of the present invention, the expiration of the first timer switches the alarm system into the second armed state. If the door is open, the second timer is triggered but the alarm will activate unless the deactivating code is entered. If the door is closed, the second timer will run until expired or the deactivating code is entered.

The first timer may be set in the range of 30 seconds to five minutes, with a preference for three minutes. The second timer may be set in the range of one to 23 hours, with a preference for eight to twelve hours.

According to another embodiment of the present invention, a LED may be mounted externally of the mailbox. The LED is operably controlled by the controller and powered by the power source. The controller turns on the LED in the armed state and turns off the LED in the unarmed state. Thus, the mailbox owner is signaled that mail has been deposited in the opening, and the LED is extinguished when the mail has been retrieved.

According to another embodiment of the present invention, the electronic mailbox may also include a locking (or latching) mechanism, which is also operably controlled by the controller and powered by the power source. The locking mechanism may include a latched solenoid and a bracket. Either the solenoid or bracket is mounted on the door and the other component is mounted on the housing such that when the solenoid is activated, the door is latched and locked to the housing until the solenoid is cycled by the controller. Thus, the opening is closed (covered) by the door in the armed state. In the unarmed state, the controller deactivates the solenoid and the door is unlocked.

The controller, magnetic switch of the magnetic sensor, alarm, illuminating light, and LED may all be mounted on a single compact tray that is mounted underneath the mailbox housing. In this manner, the components can be tested prior to assembly and are protected from the elements and the other's interference with the live components.

According to another embodiment of the present invention, the electronic mailbox may also include an illuminating light mounted within the mailbox housing. The illuminating light is operably controlled by the controller and electrically powered by the power source. The illuminating light is controlled to operate (illuminated) whenever the door is opened. This feature aids users in retrieving all mail deposited in the housing opening.

The electronic mailbox may further include a keypad illuminating light that is mounted adjacent the keypad and external of the mailbox. The keypad illuminating light is operably controlled by the controller and electrically powered by the power source. The keypad illuminating light is illuminated when a key or key sequence is depressed on the keypad.

In preferred form, the door sensor is a combination of a magnet and magnetic reed switch. Also, preferably, the power source is a six volt battery. The alarm system may include a piezo-ceramic sounder module.

According to another aspect of the present invention, the housing may include a false back plate that covers the power source to protect users from "live" parts when retrieving or delivering mail into the housing opening.

The electronic mailbox may further include a third timer that is operably controller by the controller. When the alarm is triggered, the alarm will silence by either the expiration of the third timer or by entering the deactivated code. The third timer may be set in the range of one to three minutes with a preference for two minutes.

An optional warning label may be externally fixed to the mailbox indicating an alarm system, which may act as a deterrent to mail theft. This may be especially useful if the alarm system does not have the optional locking mechanism.

According to yet another aspect of the present invention, the electronic mailbox may further include a low power sleep mode programmed into the controller that reduces the power consumption from its normal "awake" or powered state. The sleep mode is operably activated after the second timer has expired and the door is in the closed state such that the electrical power required from the power source is reduced. The sleep mode will not be switched to the awake mode until the deactivating code is entered.

In the case where the alarm system also includes the locking mechanism, the low power sleep mode is operably activated after the second timer has expired and the deactivating code has not been entered such that the door will remain locked and the electrical power requirement from the power source is reduced until the deactivating code is entered.

An optional low power monitor may be added to the control circuitry such that the monitor senses when the power source (e.g. batteries) are low. An optional second low output audible alarm may be triggered once the monitor senses the power source capacity below that of a predetermined level to notify the owner that the power source needs to be recharged/replaced.

These and other advantages, objects, and features will become apparent from the following best mode description, the accompanying drawings, and the claims, which are all incorporated herein as part of the disclosure of the invention.

BRIEF DESCRIPTION OF THE DRAWINGS

Like reference numerals are used to designate like parts throughout the several views of the drawing, wherein:

FIG. 5 is a pictorial view of a mailbox of a second alternate embodiment;

FIG. 6 is a pictorial view of a third alternate embodiment mailbox;

FIG. 7 is a plan view of the mailbox of FIG. 6 and showing the lid in an open position;

BEST MODE FOR CARRYING OUT THE INVENTION

Figure 1:
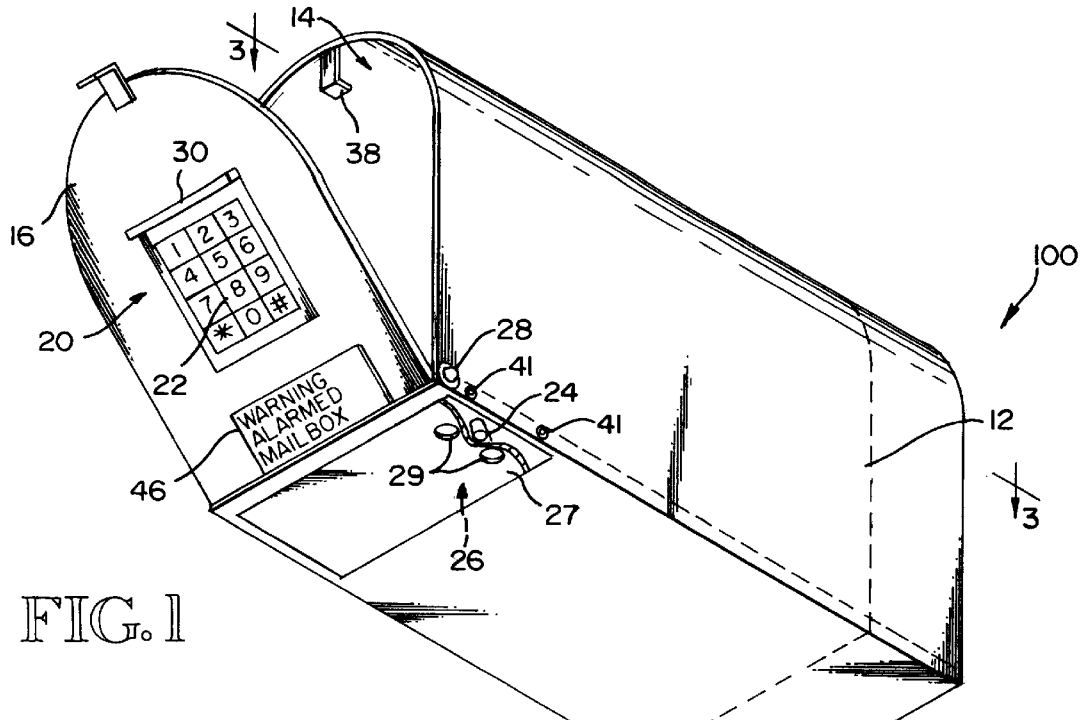
FIG. 1 is a perspective view of a mailbox of a first preferred embodiment including the keypad alarm system having a microcontroller controlled circuit board (controller) mounted on a tray positioned underneath the mailbox of the first embodiment and showing the controller controlled high output alarm mounted on the tray in cutaway.

The present invention relates to an electronic mailbox that can provide: 1) mail carrier access to the mailbox in order to deposit mail; 2) electronic recognition that mail has been placed inside the mailbox and has set an alarm system; 3) an optional locking mechanism to secure the door to the mailbox; 4) an external indication that mail is in the mailbox and needs to be picked up by the owner; 5) owner access entry to the mailbox by deactivating the alarm system through a personal identification number code (PIN) entered on a keypad arrangement, and which can also unlock the optional door lock; 6) electronic recognition that mail has been retrieved by the owner; and 7) an optional electronic low power mode (or sleep mode) to reduce power consumption when the mailbox is inactive.

Referring to FIGS. 1–7, the present invention relates to an electronic mailbox 100, 200, 300 that includes a traditional mailbox housing 12 that defines an opening 14 to hold any letters, catalogs, magazines, or packages that are delivered by the U.S. Postal Service (collectively called "mail"). Each embodiment of the present invention 100, 200, 300 includes a door 16 that is operably movable between an open state and a closed state. The door is preferably hinged or otherwise connect to housing 12. When in the closed state, door 16 covers opening 14. When door 16 is in the open state, an owner can access opening 14 and retrieve mail that may be deposited in opening 14.

Unlike a traditional standard mailbox, which could be opened by anyone with no adverse consequence, the mailbox of the present invention includes a keypad alarm system 20 that includes a 10-key (plus # and * keys for a total of 12 keys) keypad 22 positioned on the front of door 16 and an alarm 24 (shown in FIG. 1 in cutaway). Alarm 24 can emit an audible and, preferably, high intensity/high output sound. Preferably, the alarm is a 4 MHz piezo-electric crystal sounder module. The alarm system is controlled by a programmed and/or programable controller (or microcontroller-controlled circuit board) 26 between a first unarmed state and a second armed state, which is programmed to activate the alarm under certain conditions such as unauthorized opening of the mailbox door. The controller 26 will be discussed in more detail below. An authorized user can deactivate the alarm by inputting a user chosen deactivating PIN (personal identification code) code into the keypad.

The electronic mailbox of the present invention may also include an LED 28 (light emitting diode), which is mounted externally of the mailbox housing 12 to indicate that mail has been delivered. The LED may be programmed by the controller to flash intermittently for maximum visibility. Thus, when the LED is activated in the armed state, mail has been placed in the mailbox. The LED is turned off when the owner deactivates the alarm system by entering the deactivating code into the keypad or when a specific time sequence has been completed to deactivate or "unarm" the alarm system. The extinguishment of the LED lets other residents (such as a spouse) know that mail has been picked up. This feature is particularly useful where the mailbox is remote from the residence.

A small keypad illumination light 30 (FIGS. 1, 5–6), which is also controlled by controller 26, may be positioned on the front of door 16 adjacent keypad 22 to aid visibility in deactivating the alarm system in the dark. By depressing the "*" key on the keypad, the illuminating light turns on. Alternatively, this keypad illumination light may be controlled by a photoelectric cell (not shown) when the ambient light reaches a certain lumen level (such as dusk). Additionally, another small illumination light 32 (FIGS. 2A, 2), also controlled by controller 26, may be mounted inside housing 12 to illuminate opening 14 when door 16 is open.

Figure 2A:
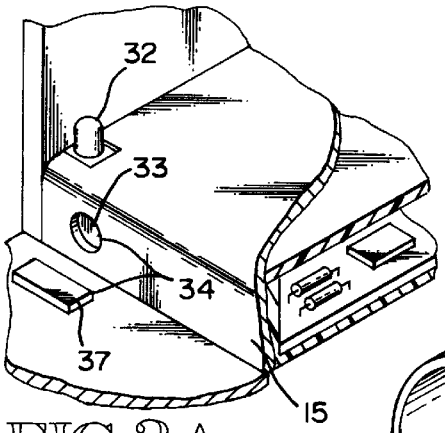
FIG. 2A is an enlarged perspective view of the control tray and mailbox housing lip.
Figure 2:
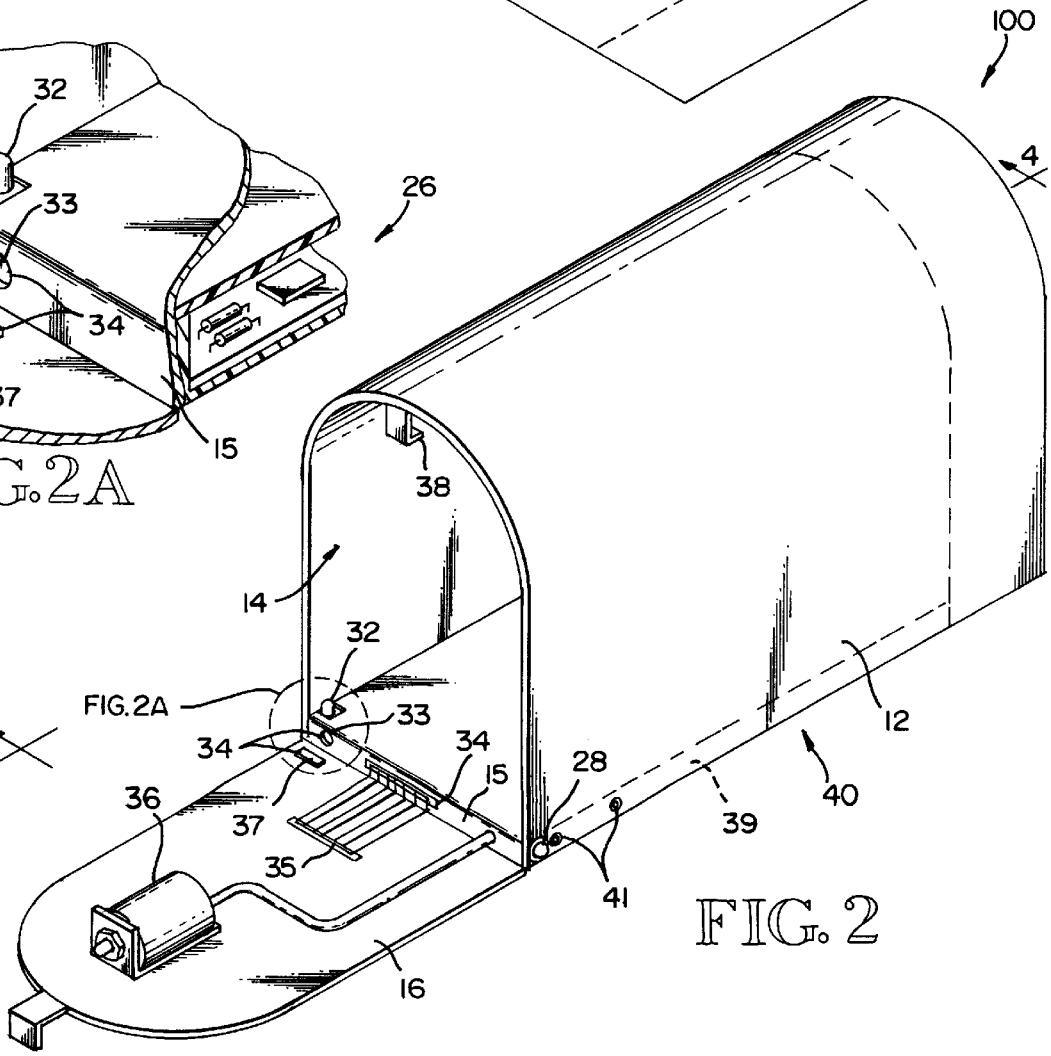
FIG. 2 is a perspective view of the mailbox of FIG. 1 and better showing the optional locking mechanism for locking the mailbox door, magnet, and illuminating light.
Figure 3:
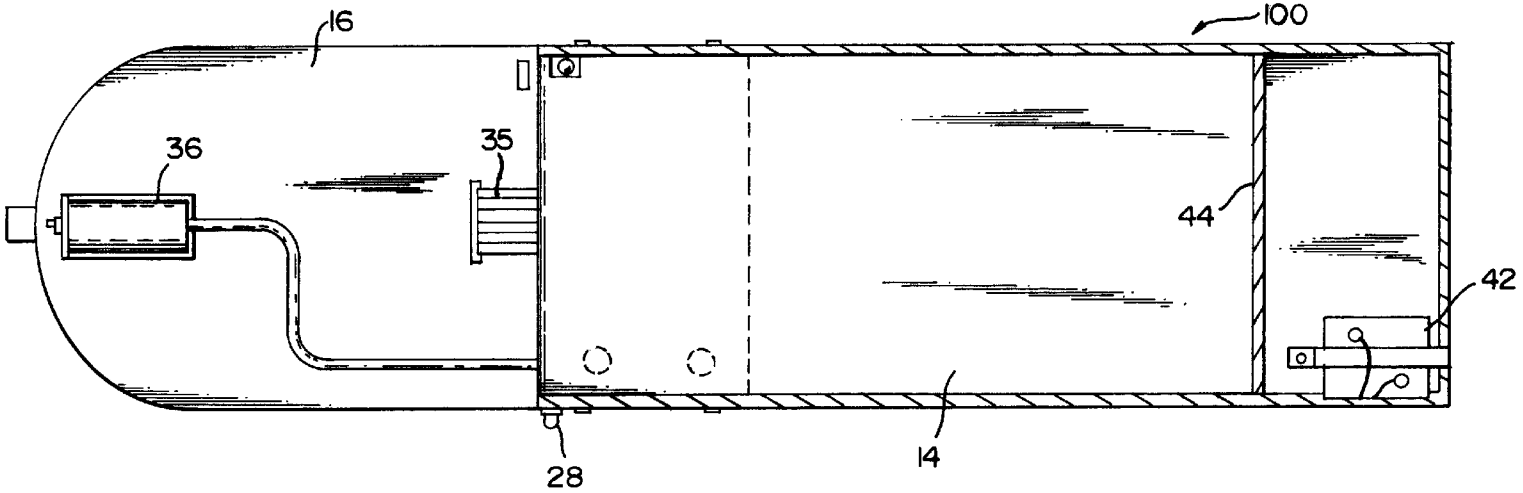
FIG. 3 is a sectional view taken substantially across lines 3—3 of FIG. 1 and better disclosing the power system and false back of the first embodiment.

Referring to FIGS. 2A–3, the present invention includes a sensor 34 for determining if door 16 is open or closed. The sensor 34 is preferably a magnetic reed switch 33 and a magnet 37 (to sense magnetic flux flow to activate reed switch) positioned between door and housing opening 14. The magnetic switch 33 senses the presence or absence of the magnet 37, and, hence, the absence or presence of the door. The controller is signaled accordingly. Other sensing devices, however, may also be used.

Electrical conductors from the keypad to the controller are shown at 35 in FIG. 2 to preferably minimally interfere with human or mechanical operation.

The mailbox may also include an optional locking mechanism that locks the door 16 to housing 12. One such locking mechanism may include a latched solenoid 36 and a latch bracket 38. The locking mechanism is also controller by the controller 26. Other locking mechanisms also may be used. The latched solenoid 36, which is electro-magnetically activated by a signal from an output transistor switch of controller 26, is mounted on the door portion facing opening 14. The latched solenoid is mounted to the interior of housing 12. When activated or armed, the latched solenoid moves to maintain a locked state between the latch bracket 38 and the latched solenoid 36; thus, door 16 is locked and can not be opened until the alarm system has been deactivated by a timed sequence or entry of a particular key pad code.

As best shown in FIG. 2A, the magnetic switch 33, as well as the controller 26 are preferably mounted on a tray 27, which is positioned underneath housing 12. Tray 27, when installed, protects the fragile circuit board components from human intervention and hazardous weather. The LED, magnetic switch 33 part of the magnetic sensor, alarm 24, and illumination light 32 are also preferably mounted on tray 27. In this way, all of the tray components can be mounted and tested prior to final assembly. Tray 27 may also include a pair of openings 29 in order to better hear alarm 24 when triggered.

Figure 4:
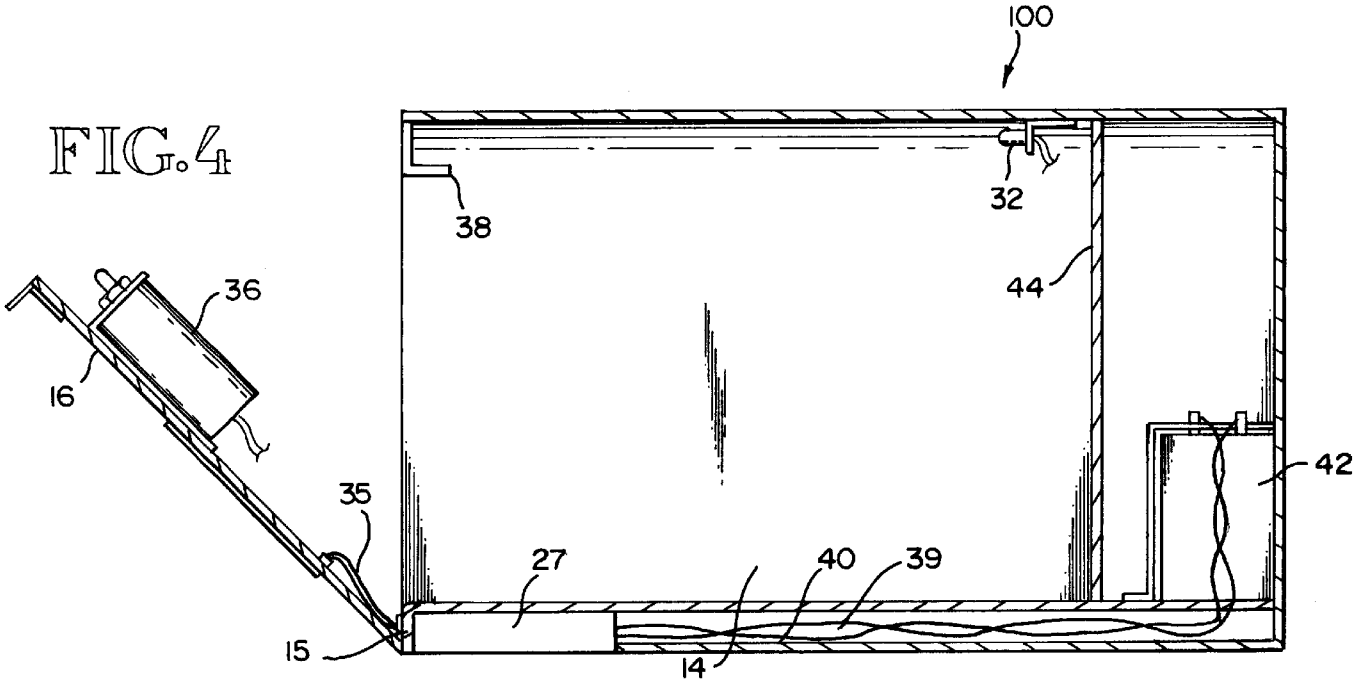
FIG. 4 is a sectional view taken substantially along lines 4—4 of FIG. 2 and better disclosing an alternate location of the illuminating lamp and a raceway channel underneath the mailbox of the first embodiment so that the power curing wires are not easily accessible by the public, and with door angled approximately 45 degrees.

Referring also to FIGS. 3 and 4, tray 27 is positioned in bottom 40 of housing 12, confronted against a lip 15 of mailbox housing adjacent opening 14. A raceway channel 39 protects electrical conduits that run from a power source, discussed further below, to the controller 26. By mounting these components on bottom 40 of housing 12, these components are less likely to be damaged by weather and by vandals (as they are not in clear view), and by the owner when the owner is "rooting around" in the mailbox opening with his or her arm for mail.

Referring now to FIGS. 3–4, and 7, a power source 42 is required to power the controller 26, alarm system 24, LED 28, illuminating lights 30, 32, magnetic sensor 34, as well as the solenoid 36. A six volt battery may be used for the embodiments of FIGS. 1–4. Four C batteries may be used for the embodiments shown in FIGS. 5–7.

In order to protect users from "live" components, a false back 44 (FIGS. 3 and 4) may be added to the interior of mailbox 100 to shield the alarm and a battery from human contact. A protective barrier 45 (FIG. 8) acting as a false bottom in FIGS. 5–7 may also be used to shield live parts.

It should be noted that the LED, the illumination lights, keypad, locking mechanism components, and batteries are shelf good items. The various mailbox housings are also shelf good items. Thus, the cost to manufacture the present invention is kept intentionally low.

Referring to FIGS. 8–13, key to the operation of the alarm system of the present invention is a programmed microcontrolled circuit board or controller 26 which includes a microcontroller U2, such as a Motorola Model MC68HC70552, that operates various control functions between an armed (or activated) state and a unarmed (or deactivated state). Although most functions are preprogrammed, certain aspects may be programmable such as length of the timers.

The mailbox is programed to be deactivated when a mailperson typically delivers mail (for example, late in the morning). Once the mailbox door is opened, a first timer is activated (in FIG. 8, referred to as the "three minute timer"). Additionally, the microcontroller may be programmed to turn on the illuminating lights 32 once the door is opened.

The first timer begins while a sensor continuously signals to the microcontroller whether the mailbox door is open or closed.

The first timer can be programmed from anywhere from 30 seconds to five minutes or more. Preferably, the first timer is set for three minutes. In this way, a mailperson has sufficient time to insert mail and insert newly discovered piece of mail within a reasonable amount of time without activating the alarm.

Once the timer has expired or the door is closed (after the initial opening), the mailbox enters the armed state. Alternatively, as shown schematically in FIGS. 11 and 13, the first timer expires before the alarm system switches to the armed state. In this manner, the mailperson is less likely to trigger the alarm when immediately reopening the door for newly discovered mail. If the mailbox door is still opened after the first timer has expired, the mailbox will immediately go into its armed state and trigger the alarm system. If the door is closed, the mailbox will be armed but also a second timer will be activated. Once in the armed state, the microcontroller is programmed to turn on the LED to signify that mail has arrived. Additionally, the illumination light is extinguished.

The second timer is designed to give sufficient time for the authorized user to arrive home from work and retrieve the mail from the time the mail is initially deposited. As such, the timer may be programmed in the range of 1–23 hours. The flow chart in FIG. 8 designates this second times as the "eight hour timer."

If an authorized user (the owner) enters a particular deactivating PIN code into the keypad arrangement the alarm system will be deactivated and the LED will be extinguished.

Figure 13:
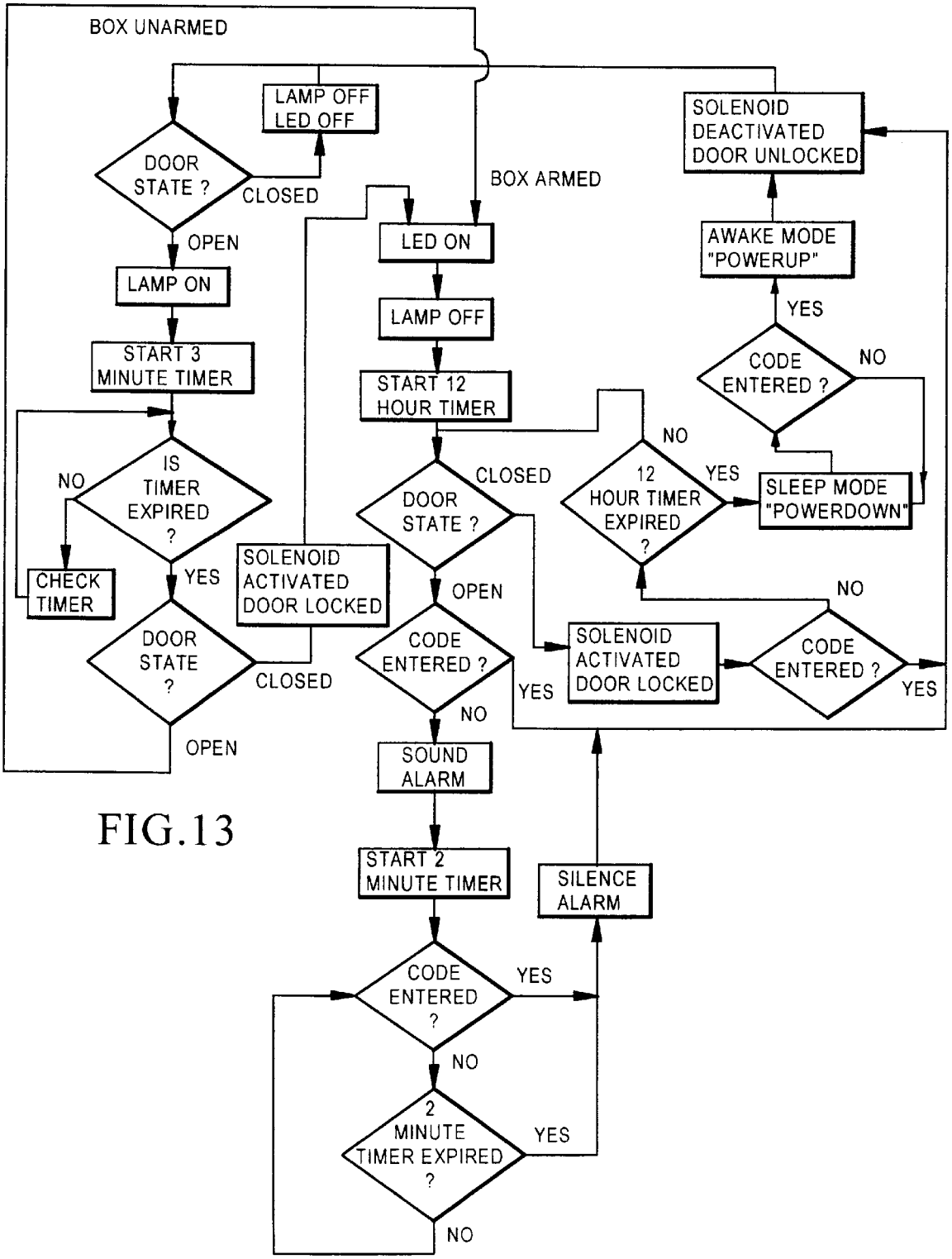
FIG. 13 is another schematic diagram depicting a fourth alternate flow chart of the present invention.

Referring to FIG. 13, a low power "sleep mode" is activated if the second timer expires and the PIN code has not been entered. The sleep mode is a built-in time-out mode that when activated allows the microcontroller to "power down" to require only a small amount of current from the battery. Thus, the efficacy of the system is maximized, while operating costs are reduced.

When the owner has returned to eventually collect his or her mail, the owner need to reenter the PIN code to "power-up"the alarm system into the "awake" (not sleep) mode.

Figure 8:
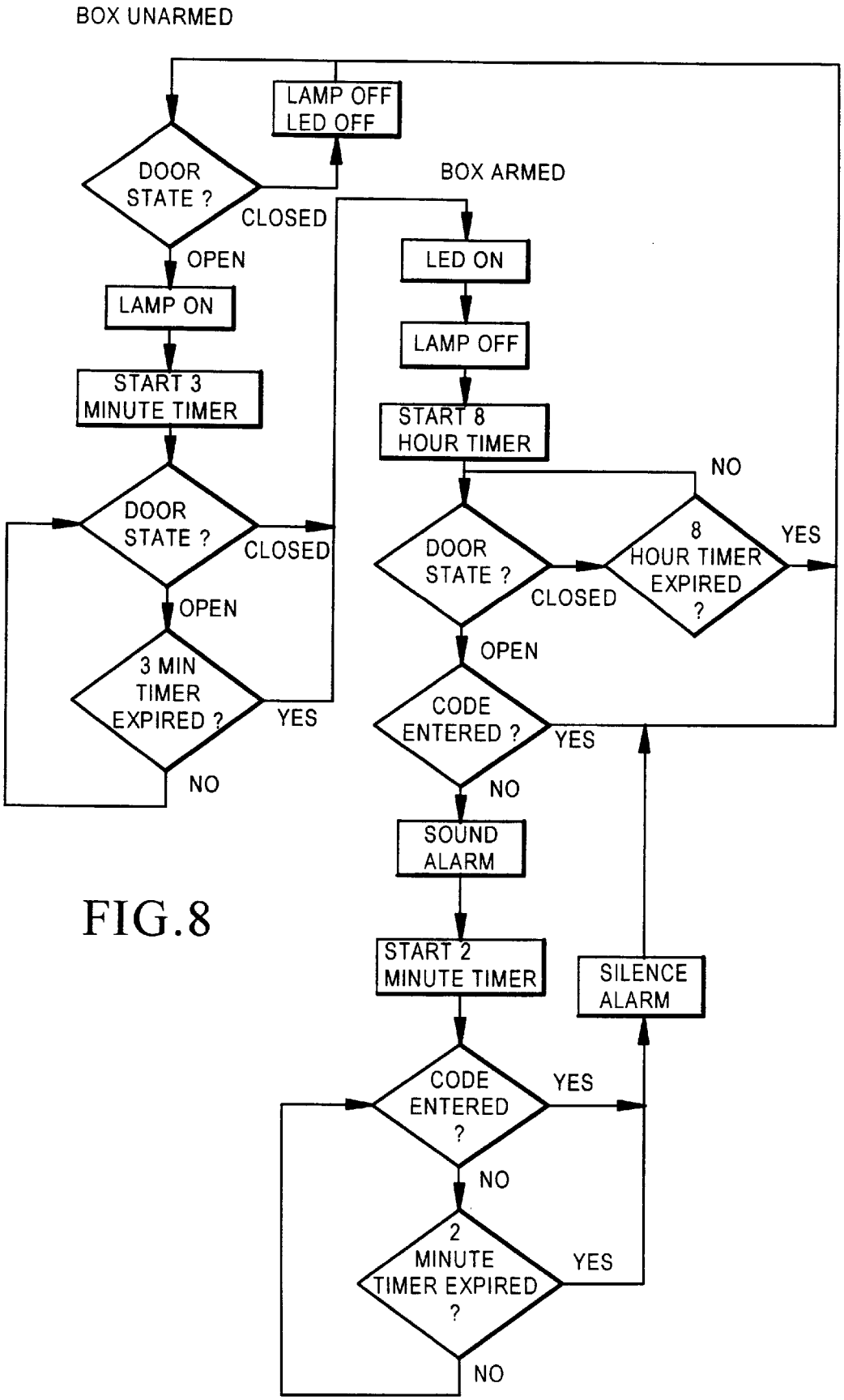
FIG. 8 is a flow chart of the functions of the electronic mailbox of the present invention.
Figure 11:
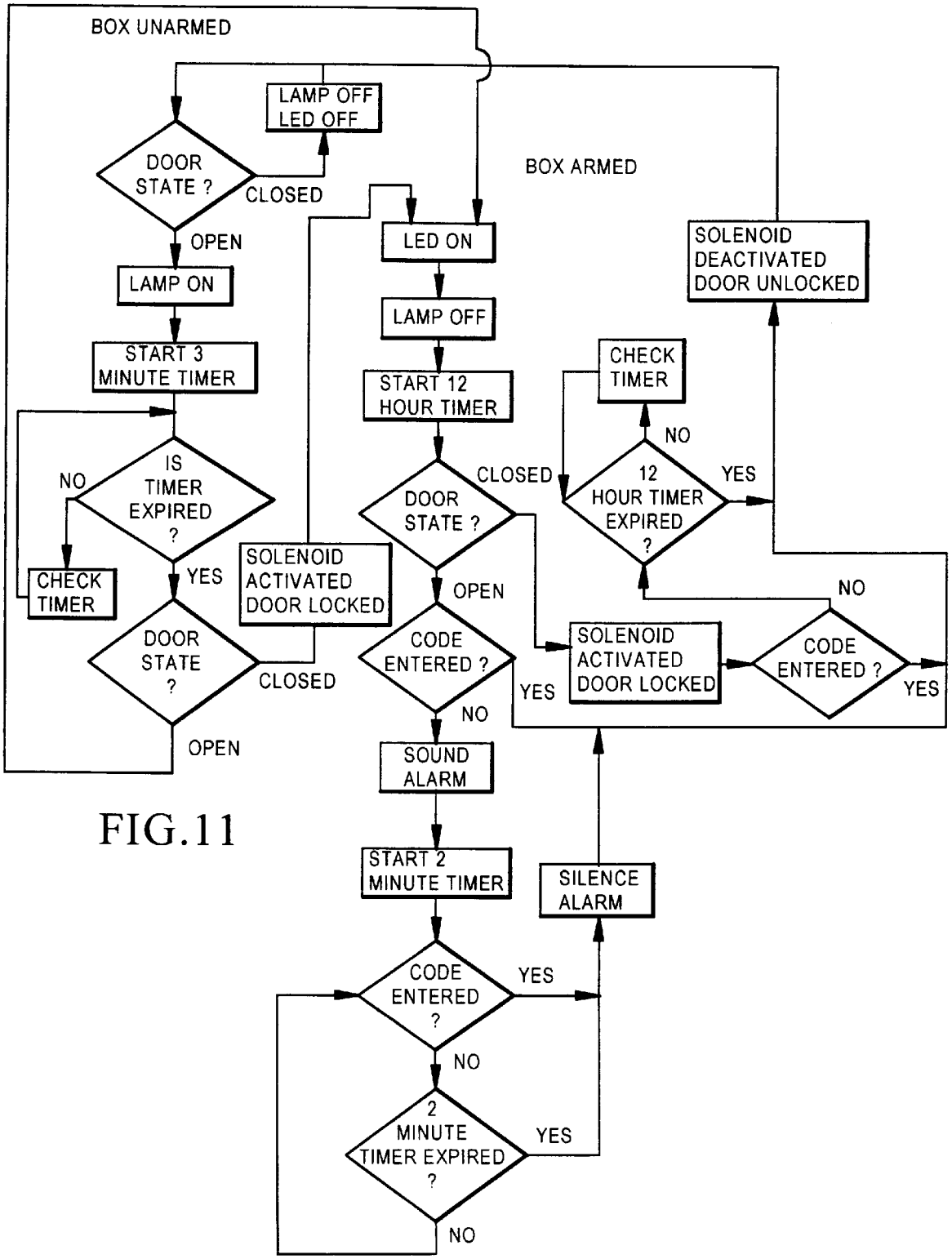
FIG. 11 is a schematic diagram depicting a second alternate flow chart arrangement of the electronic functions of the present invention.
Figure 12:
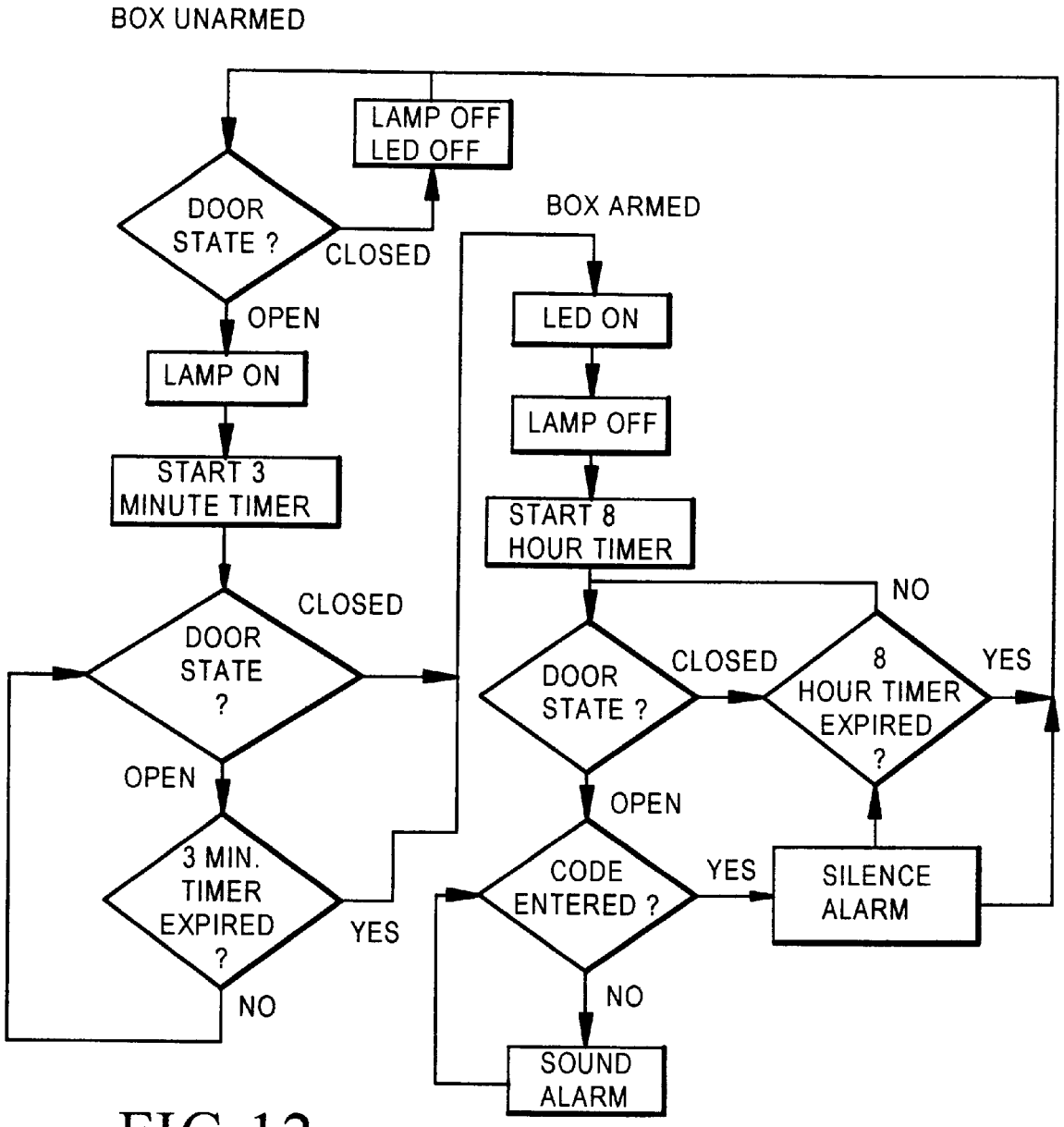
FIG. 12 is another schematic diagram depicting a third alternate flow chart arrangement.

The present invention may also include a third timing system, which is also controlled by the controller. As shown in FIGS. 8, 11 and 13, if the alarm is activated, a third timer can be used to silence the alarm within a reasonable time, whether deactivated by the owner or not. Typically, this third timer may be in the range of two minutes. Thus, false alarm triggers can be automatically silenced once the third timer has expired and do not require contacting the owner to silence the alarm system. This can be especially helpful in high density areas where a false alarm can be of great annoyance to neighbors or even an actionable nuisance.

Optimally, as shown in FIGS. 11 and 13, the door locking mechanism is activated in the armed state and deactivated in the unarmed state.

Security is added by the ability to store owner supplied information into a volatile memory by a serial data EEPROM (electronically erasable program read-only memory). The owner is, thus, able to store a chosen PIN into the volatile memory or select a new PIN at will.

Figure 9:
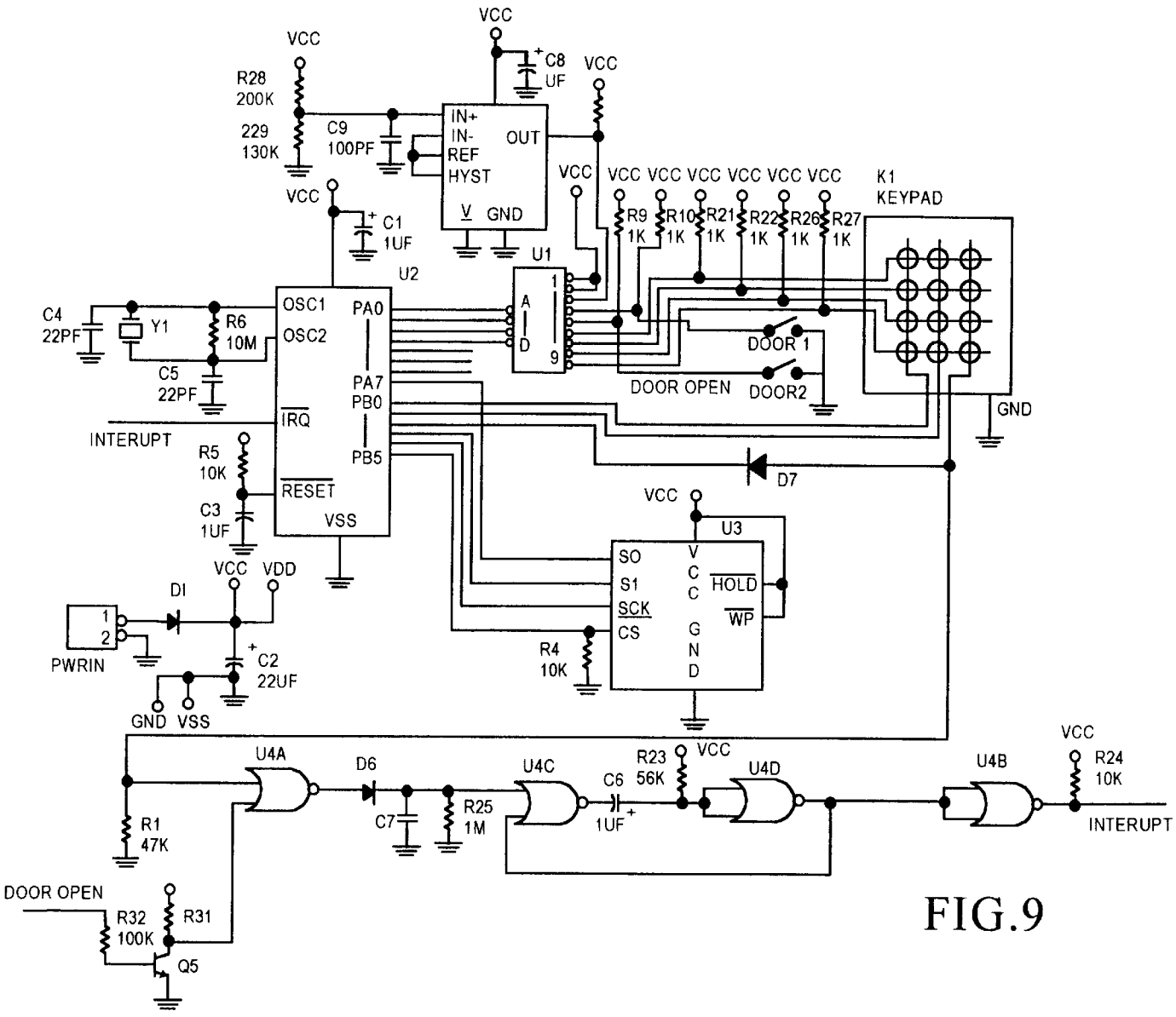
FIG. 9 is a control diagram of the microcontroller controlled circuit board.
Figure 10A:
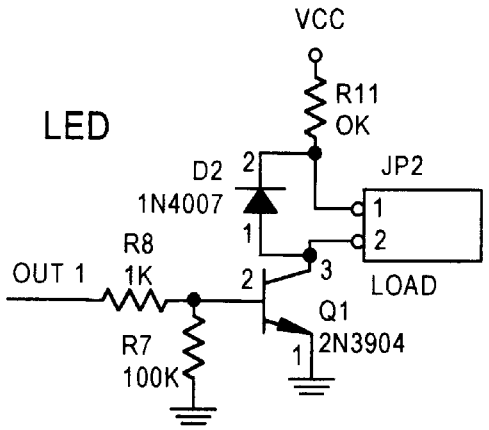
FIGS. 10A–D are schematic diagrams of various output functions from the controller.
Figure 10B:
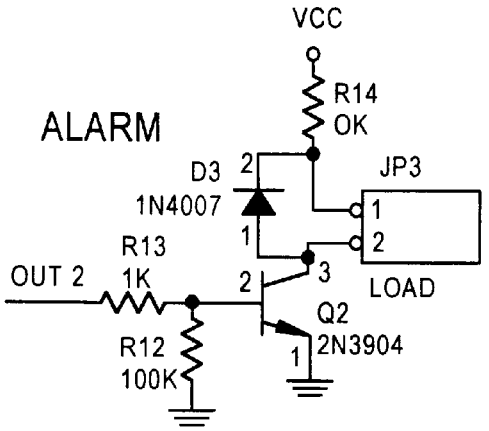
Figure 10C:
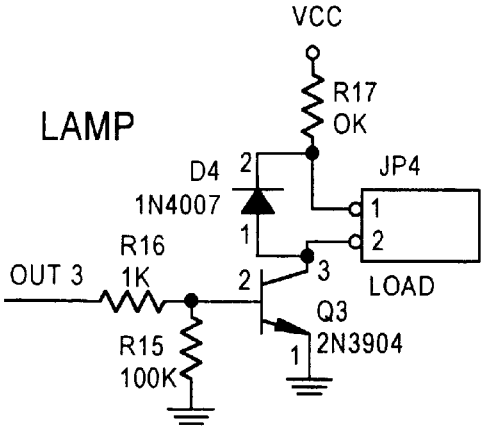
Figure 10D:
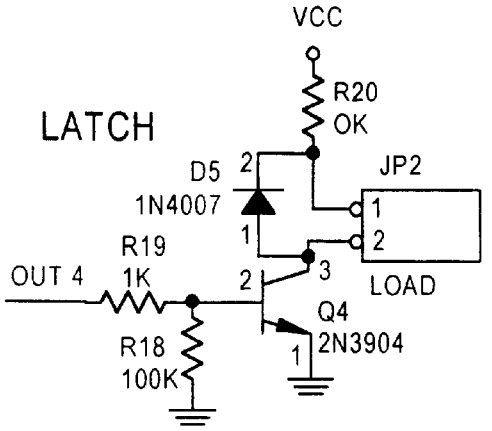

Referring to FIG. 9, in preferred form, microcontroller U2 has two ports labeled PAO–PA7 and PB0–PB5 that provide the digital data input and output functions. The inputs to microcontroller U2 are the magnetic door sensor switch labeled S2 (door 2), the keypad switch closures K1, and date from the U3 non-volatile memory. Outputs of microcontroller U2 are used to activate LED 28, illuminating lights 30 and 32, and activating alarm 24, as well as cycling latch solenoid 36.

Inputs to the microcontroller U2 are multiplexed by a 10-4 line priority encoder U1. The keypad's 4-row inputs are interconnected to half of the input pins of U1. The remaining unused pins are connected to a logic high voltage. With no switch closures, all the input lines to U1 are at a logic high level due to the pull-up resistors R9, R10, R21, R22, R26, R27. Magnetic sensors switch door 2 and an optional switch (door 1) are also connected at the input pins of U1.

Optional door 1 may be connected to other desired components such as a liquid level alarm that triggers an alarm if the liquid level alarm (not shown) is broken (such as vandals wielding baseball bats and deliberately destroying the mailbox).

Door activation will activate U4, a keypad switch activator. U4 (sections A–D) form a pulse generator that will trigger the interrupt line on the microcontroller any time the lower right pad of the keypad is depressed.

A low voltage monitor U5 is connected to the priority encoder U1. U5 detects when the battery goes below a predetermined level to signal the microcontroller U2 that the battery voltage is low. An optional alarm beep may be triggered when the owner retrieves mail to indicate a change of batteries is needed. The priority encoder has an optional door switch 1 (S1) as the highest priority. S2, the magnetic door switch at door 2, is the next highest priority. Row 1 through row 4 of keypad K1 is then the next level of priority. The microcontroller U2 continually places low logic low pulses one at a time, when in the awake state, on columns, 1, 2, and 3.

Depression of any keypad switch causes the "low going column pulse" to be transferred to the corresponding row line. Priority encoder U1 then sends a unique BCD (binary coded decimal) value to microcontroller U2. Microcontroller U2 then compares its input to see if a unique code has been inputted. If a key switch has been depressed, microcontroller U2 recognizes which one of the keypad switches was depressed. Once a keypad switch closure is detected, U2 sequentially places a low pulse under the three keypad columns via PB0, PB1, and PB2. Microcontroller U2 places a low pulse on PB0 for the first row of keypad switches. Simultaneously, while placing a low pulse on PB0, U2 checks the data lines PA0–PA3 for the unique input codes from the priority encoder that would designate which, if any, switch in column one was activated by pressing with the fingertip. U2 then places the PB0 line in the high state and the PB1 line in the low state. If any column two keypad switch has been depressed, then a low state will appear at the input to the priority encoder. U2 again reads the input lines PB0–PB3 and checks to see if a column two switch has been depressed. PB1 line is placed to a high level by U2. PB2 is placed in a logic low condition. If any column three keypad switch has been depressed, then priority encoder U1 will place a unique BCD code that correspondence to the third column to keypad switch closure. U2 then repeats the sequence again to continually scan for keypad inputs. Continuous scanning occurs at a higher rate than that which the user can physically depress on the keypad switches to ensure that the microcontroller U2 catches all keypad switch closures.

Referring to FIGS. 10A–10D, after the proper keypad switch sequences have been inputted by the user, the microcontroller U2 signals to output transistors Q1–Q4. Q1 is used to activate or deactivate the LED. Q2 is used to activate or deactivate the alarm system. Q3 is used to turn the illumination lamp on or off. Q4 is used to cycle the latch solenoid. Logic high outputs of U2 on PA4–PA7 drive the output transistors. The output transistors act as solid state switches and direct the circuit connection to ground for the indicator devices.

Device U3 is the serial data stream EEPROM that performs the data memory function. U3 may be programmed to receive serial data via PB3's input line. PB4 provides a synchronous serial clock for U3 to receive and transmit data to and from the memory. Data is transmitted to U2 by PA7.

Power from the circuit board comes in on JP1 and is reverse voltage protected by a series of blocking diodes D1. Power, as already discussed above, it supplied by the battery 42.

Software to program the controller is dictated by the desired functions and flow charts specified herein. Thus, the required software to operate the controller is considered to be of ordinary skill in the art.

Optionally, a warning label 46 may be adhered to the front of door 16 as an additional deterrent to mail theft in the event that the optional latch solenoid is still needed and the box is always unlocked. The warning label may be read "WARNING—Alarmed Mailbox" or some other similar statement.

Although the electronic functions may be complex, the user instructions are relatively simple and are no more difficult than operating a typical electronic household appliances. The cost to purchase the present invention and operate are low.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, which are to be interpreted according to accepted doctrines of claim interpretation, including use of the doctrine of equivalents and reversal of parts.

What is claimed is:

1. An electronic mailbox comprising:

a mailbox housing defining an opening of a size and shape to receive mail;

a door being of a size and shape to cover said opening, said door movably operable between an open state in which the opening is accessible, and a closed state in which the door covers the opening;

an alarm system operably controlled by a programmed controller between a first unarmed state and a second armed state, said alarm system including an alarm that emits an audible sound when activated in the second armed state and a programmable keypad mounted externally of the mailbox, wherein said programmable keypad can accept a deactivating code by an authorized user in order to deactivate the alarm in the second armed state;

a door sensor sensing and signaling a change of the door's status between the open and closed states to the controller;

a first timer operably controlled by the controller and activated by opening the door in the first unarmed state;

a second timer operably controlled by the controller and activated in the second armed state either by the expiration of the first timer or receiving a signal that the door is in the closed state after an initial opening of the door in the unarmed state, and a power source to provide electrical power to the controller, door sensor, and alarm system;

wherein, in use, a mail delivery person opens the door and delivers mail into the opening of the mailbox housing in the unarmed state, which, in turn, sets the first timer, and wherein the expiration of the first timer or closure of the door switches the alarm system into the second armed state, and wherein either the expiration of the second timer or the entry of a deactivation code on the keypad deactivates the alarm system and is switched to the first unarmed state, and wherein opening of the door in the armed state will activate the alarm unless the deactivation code is entered prior to opening.

2. The electronic mailbox according to claim 1, further comprising:

an LED mounted externally of the mailbox in which the LED is operably controlled by the controller and powered by the power source in order to turn on the LED in the armed state and turn off the LED in the unarmed state.

3. The electronic mailbox according to claim 2, further comprising:

an illuminating light mounted within the mailbox housing, said illuminating light being operably controlled by the controller and electrically powered by the power source, said illuminating light being illuminated whenever the door is sensed by the controller to be open.

4. The electronic mailbox according to claim 3 further comprising:

a tray that mounts underneath the mailbox housing, said tray including the controller, the alarm, the LED, and the illuminating light.

5. The electronic mailbox according to claim 1, further comprising:

a locking mechanism operably controlled by the controller and powered by the power source, said locking mechanism further including a latch solenoid and a bracket wherein either the solenoid or bracket is mounted on the door and the other is mounted on the housing such that when the solenoid is activated, the door is locked to the housing to cover the opening when the controller activates the solenoid in the armed state and wherein the controller deactivates the solenoid in the unarmed state.

6. The electronic mailbox according to claim 5, wherein the controller is further programmed to include a low power sleep mode in the armed state from its normal awake state, said sleep mode is operably activated after the second timer has expired and the deactivating code has not been entered such that the door remains locked and the electrical power required from the power source is reduced, and wherein the sleep mode will not be switched to the awake mode until the deactivating code is entered.

7. The electronic mailbox according to claim 6, further comprising:

an LED mounted externally of the mailbox in which the LED is operably controlled by the controller and powered by the power source in order to turn on the LED in the armed state and turn off the LED in the unarmed state.

8. The electronic mailbox according to claim 1, further comprising:

an illuminating light mounted within the mailbox housing, said illuminating light being operably controlled by the controller and electrically powered by the power source, said illuminating light being illuminated whenever the door is sensed by the controller to be open.

9. The electronic mailbox according to claim 8, further comprising:

a keypad illuminating light mounted adjacent the keypad and external of the mailbox, said keypad illuminating light operably controlled by the controller and electrically powered by the power source, said keypad illuminating light is illuminated when a key on the keypad is depressed.

10. The electronic mailbox according to claim 1, further comprising:

a keypad illuminating light mounted adjacent the keypad and external of the mailbox, said keypad illuminating light being operably controlled by the controller and electrically powered by the power source, said keypad illuminating light being illuminated when a key on the keypad is depressed.

11. The electronic mailbox according to claim 1, wherein the door sensor includes a magnet and a magnetic reed switch.

12. The electronic mailbox according to claim 1, wherein the power source includes a six-volt battery.

13. The electronic mailbox according to claim 1, wherein the alarm system includes a piezo-ceramic sounder module.

14. The electronic mailbox according to claim 1, wherein the housing further includes a false back plate that covers the power source and the alarm from human access when accessing the opening to deliver or retrieve mail.

15. The electronic mailbox according to claim 1, further comprising:

a third timer being operably controlled by the controller such that when the alarm is triggered, the alarm will silence once the third timer expires.

16. The electronic mailbox according to claim 15, wherein the third timer is set in the range of 1–3 minutes.

17. The electronic mailbox according to claim 16, wherein the third timer is set for two minutes.

18. The electronic mailbox according to claim 1, wherein the first timer is set in the range of 30 seconds to 5 minutes.

19. The electronic mailbox according to claim 18, wherein the first timer is set for 3 minutes.

20. The electronic mailbox according to claim 1, wherein the second timer is set in the range of 1–23 hours.

21. The electronic mailbox according to claim 20, wherein the second timer is set in a range of 8–12 hours.

22. The electronic mailbox according to claim 1, further comprising:

a warning label fixedly attached to an exterior portion of the mailbox.

23. The electronic mailbox according to claim 1, wherein the controller is furthered programmed to include a low power sleep mode in the armed state from its normal awake state, said sleep mode is operably activated after the second timer has expired and the door is in the closed state such that the electrical power required from the power source is reduced, and wherein the sleep mode will not be switched to the awake mode until the deactivating code is entered.

24. The electronic mailbox according to claim 1, further comprising:

a low voltage monitor controlled by the controller and powered by the power source, said monitor senses the output voltage from the power source and signals the controller at a predetermined voltage.

25. The electronic mailbox according to claim 24, further comprising:

a second alarm controlled by the controller and powered by the power source to emit an audible sound when the controller receives a signal from the monitor that the output voltage of the power source is at the predetermined voltage.

26. An electronic mailbox comprising:

a mailbox housing defining an opening of a size and shape to receive mail;

a door being of a size and shape to cover said opening, said door movably operable between an open state in which the opening is accessible, and a closed state in which the door covers said opening;

an alarm system operably controlled by a programmed controller between a first unarmed state and a second armed state, said alarm system including an alarm that emits an audible sound when activated in the second armed state and a programmable keypad mounted externally of the mailbox, wherein said programmable keypad can accept a deactivating code by an authorized user in order to deactivate the alarm in the second armed state;

a door sensor sensing and signaling a change of the door's status between the open and closed states to the controller;

a first timer operably controlled by the controller and activated by opening the door in the first unarmed state;

a second timer operably controlled by the controller and activated in the second armed state by the expiration of the first timer; and a power source to provide electrical power to the controller, door sensor, and alarm system;

wherein, in use, a mail delivery person opens the door and delivers mail into the opening of the mailbox housing in the unarmed state, which, in turn, sets the first timer, and wherein the expiration of the first timer or closure of the door switches the alarm system into the second armed state, and wherein either the expiration of the second timer or the entry of a deactivation code on the keypad deactivates the alarm system and is switched to the first unarmed state, and wherein opening of the door in the armed state will activate the alarm unless the deactivation code is entered prior to opening.

27. An electronic mailbox comprising:

a mailbox housing defining an opening of a size and shape to receive mail;

a door being of a size and shape to cover said opening, said door movably operable between an open state in which the opening is accessible, and a closed state in which the door covers said opening;

an alarm system operably controlled by a programmable controller between a first unarmed state and a second armed state, said alarm system including an alarm that emits an audible sound when activated in the second armed state and a programmable keypad mounted externally of the mailbox, wherein said programmable keypad can accept a deactivating code by an authorized user in order to deactivate the alarm in the second armed state;

a door sensor sensing and signaling a change of the door's status between the open and closed states to the controller;

a first timer operably controlled by the controller and activated by opening the door in the first unarmed state;

a second timer operably controlled by the controller and activated in the second armed state either by the expiration of the first timer or receiving a signal that the door is in the closed state after an initial opening of the door in the unarmed state, and a power source to provide electrical power to the controller, door sensor, and alarm system;

wherein, in use, a mail delivery person opens the door and delivers mail into the opening of the mailbox housing in the unarmed state, which, in turn, sets the first timer, and wherein the expiration of the first timer or closure of the door switches the alarm system into the second armed state, and wherein either the expiration of the second timer or the entry of a deactivation code on the keypad deactivates the alarm system and is switched to the first unarmed state, and wherein opening of the door in the armed state will activate the alarm unless the deactivation code is entered prior to opening.

28. An electronic mailbox comprising:

a mailbox housing defining an opening of a size and shape to receive mail;

a door being of a size and shape to cover said opening, said door movably operable between an open state in which the opening is accessible, and a closed state in which the door covers said opening;

an alarm system operably controlled by a programmed and programmable controller between a first unarmed state and a second armed state, said alarm system including an alarm that emits an audible sound when activated in the second armed state and a programmable keypad mounted externally of the mailbox, wherein said programmable keypad can accept a deactivating code by an authorized user in order to deactivate the alarm in the second armed state;

a door sensor sensing and signaling a change of the door's status between the open and closed states to the controller;

a first timer operably controlled by the controller and activated by opening the door in the first unarmed state;

a second timer operably controlled by the controller and activated in the second armed state either by the expiration of the first timer or receiving a signal that the door is in the closed state after an initial opening of the door in the unarmed state, and a power source to provide electrical power to the controller, door sensor, and alarm system;

wherein, in use, a mail delivery person opens the door and delivers mail into the opening of the mailbox housing in the unarmed state, which, in turn, sets the first timer, and wherein the expiration of the first timer or closure of the door switches the alarm system into the second armed state, and wherein either the expiration of the second timer or the entry of a deactivation code on the keypad deactivates the alarm system and is switched to the first unarmed state, and wherein opening of the door in the armed state will activate the alarm unless the deactivation code is entered prior to opening.

* * * * *